US005181997A

United States Patent [19]

Kaneko et al.

[11] Patent Number: 5,181,997

[45] Date of Patent: Jan. 26, 1993

[54] APPARATUS AND METHOD FOR CONTINUOUSLY ELECTROLYZING ALUMINUM PRODUCTS

[75] Inventors: Nobuyoshi Kaneko; Tsutomu Kakei, both of Shizuoka, Japan

[73] Assignee: Fuji Photo Film Co., Ltd., Kanagawa, Japan

[21] Appl. No.: 676,516

[22] Filed: Mar. 28, 1991

[30] Foreign Application Priority Data

Jun. 19, 1990 [JP] Japan ..... 2-158795
Sep. 25, 1990 [JP] Japan ..... 2-251850

[51] Int. Cl.[5] ..... C25F 1/00; C25F 3/00; C25F 3/20; C25F 7/00

[52] U.S. Cl. ..... 204/129.1; 204/129.2; 204/140; 204/206; 204/211; 204/269

[58] Field of Search ..... 204/129.1, 129.2, 140, 204/206, 211, 269

[56] References Cited

U.S. PATENT DOCUMENTS 3,935,080 1/1976 Gumbinner et al. ..... 204/129.1 X
4,214,961 7/1980 Anthony ..... 204/211 X
4,497,695 2/1985 Shinkai et al. ..... 204/211 X

*Primary Examiner*—Donald R. Valentine

*Attorney, Agent, or Firm*—Sughrue, Mion, Zinn, Macpeak & Seas

[57] ABSTRACT

An electrolytic treatment apparatus for continuously electrolyzing an elongated product of aluminum or an aluminum alloy at a low electrolyzing voltage and reduced amount of electric power. The apparatus includes at least one electrolytic section and front- and rear-side power supply section disposed respectively at front and rear sides of the electrolytic section in the longitudinal direction of the elongated product in the electrolytic section. Each of the power supply sections contains at least one electrode, and the electrolytic section contains a plurality of electrodes. The electrolytic section and the power supply sections are filled with an electrolyte in which the elongated product and the electrodes is immersed. A plurality of power sources are provided, with an electrode of the electrolytic section at a front-side portion thereof being connected to an electrode of the front-side power supply section through one of the power sources, and another electrode of the electrolytic section at a rear-side portion thereof being connected to an electrode of the rear-side power supply section through another of the power sources. The invention also provides an electrolytic treatment method by which the above apparatus is operated.

17 Claims, 2 Drawing Sheets

APPARATUS AND METHOD FOR CONTINUOUSLY ELECTROLYZING ALUMINUM PRODUCTS

BACKGROUND OF THE INVENTION

The present invention generally relates to a method for continuously electrolyzing an elongated product such as strip, wire, foil, or the like of aluminum or an aluminum alloy, and to an apparatus for use for practicing such an electrolytic treatment. More particularly, the invention relates to an electrolytic treatment apparatus and a method for electrolytic treatment which overcomes various problems which occur in the high-speed running of a production line or in the electrolytic treatment of a thickly coated product.

Conventionally, continuous electrolytic treatment of an elongated product of aluminum or-an aluminum alloy (hereinafter simply referred to as an aluminum product) has been used widely, not only as an anodizing treatment for use in producing planographic supports, aluminized wires, electrolytic capacitors, etc., but also in an electrolytic coloring treatment, electrolytic polishing treatment, electrolytic etching treatment, and the like.

More particularly, a conventional electrolytic treatment apparatus as shown in FIG. 3 has been commonly used for continuous electrolytic treatment for an aluminum product. An electrolytic treatment method using such an apparatus is known, for example, as disclosed in Japanese Patent Unexamined Publications Nos. Sho-48-26638 and Sho-47-18739, and Japanese Patent Publication No. Sho-58-24517. Such a method involves an electrolytic treatment in which electric power is fed by a so-called submerged power supply system. For example, in a DC anodizing method using a conventional apparatus, an aluminum product 1, which is an object to be treated, runs from the left to the right in FIG. 3. An electrolytic treatment cell is constituted by three cells, that is, a power supply section 2 for negatively charging the aluminum product 1, an electrolytic 10 section 4 for electrolyzing the negatively charged aluminum product 1, and an intermediate section 3 provided for preventing a current from flowing between the respective cells of the power supply section 2 and the electrolytic section 4. In this case, currents from DC power sources 7*a* and 7*b* flow from a power supply electrode 5 into the aluminum product 1 through the electrolyte in the power supply section 2. Further, the currents flow into the aluminum product 1 toward the electrolytic section 4, and flow from the aluminum product 1 into electrolytic electrodes 6*a* and 6*b* through the electrolyte in the electrolytic section 4. In the electrolytic section 4, an anodic oxidation coating film is generated on the surface of the aluminum product 1.

According to the submerged power supply method, it is possible to prevent generation of sparks in power feeding and the generation of scar faults and the like because the object to be treated is not brought into contact with electrodes or the like, unlike the conventional direct power supply method. It is therefore possible to realize a highly stable electrolytic treatment line. In this method, however, it is necessary to increase the magnitude of the current supplied when the speed of the electrolytic treatment line is increased for the purpose of improving productivity or when the quantity of anodic oxidation coating film must be increased for the purpose of improving the product quality. When the magnitude o of the supplied current is raised, the voltage drop due to ohmic loss in the aluminum product 1 increases, and it is therefore necessary to employ power supplies capable of providing a high electrolytic voltage.

As a result of such an increase of the current and voltage of the power supply, the cost of the requisite electric power is increased, thereby increasing production costs. Also, the larger power source increases the equipment cost. Moreover, increasing the electrolytic voltage increases the amount of Joule heating generated in the aluminum product 1 in the o portion between the power supply electrode 5 and each of the electrolytic electrodes, resulting in an increase in costs associated with cooling the aluminum product 1 and the electrolytes to a regulated temperature.

In the intermediate section 3 between the power supply section 2 and the electrolytic section 4, all the currents to be supplied to the aluminum product 1 flow in such a manner that, in the case of a product having a small cross-sectional area such as a wire, foil, thin strip, or the like, heat is excessively generated, thereby resulting in fusing of the aluminum product 1. Consequently, there is a limit to increasing the feeding current, and it has been therefore difficult to increase the speed of treatment using the conventional method.

Further, for example, in the case where there is employed a post-treatment step following the electrolytic treatment involving, for example, application of an organic solvent, it has generally been necessary to ground the aluminum product following the electrolytic treatment step using, for example, a grounding roll 8 as shown in FIG. 4. The reason for this is to prevent explosion, ignition, or the like due to an increase of the electric potential of the aluminum product in the post-treatment steps.

In this method, however, the electric potential of a portion of the aluminum product at the front side of the electrolytic treatment section is higher than ground potential, although the electric potential of a portion of the aluminum product at the rear side of the electrolytic treatment section is substantially equal to ground potential. A current is therefore generated which flows from the electrolytic treatment section to the forward portion along a line through the aluminum product. Due to this current, various problems such as corrosion of metal parts used in supporting pipes or a liquid carrier pump, sparking, leakage of electricity, or the like occur in various devices for used in treatments preceding the electrolytic treatment.

Further, there has been a problem in that, in order to prevent the foregoing problems, it is necessary to use a noncorrosive material or an insulating material in constructing the equipment, which makes the equipment complicated, increasing the equipment cost as well as the maintenance cost.

Moreover, if the speed of the electrolytic treatment line is increased for the purpose of improving productivity or when the thickness of an anodic oxidation coating film is increased for the purpose of improving product quality, it is particularly necessary to increase the magnitude of the feeding current, and therefore the electrical potential of the aluminum product at a portion thereof at the front side of the electrolytic treatment section becomes higher, which exacerbates the foregoing problems.

SUMMARY OF THE INVENTION

An object of the present invention, therefore, is to provide an electrolytic treatment apparatus in which the foregoing problems of the conventional apparatus and method are eliminated and in which it is possible to considerably reduce operating costs such as the electric power cost, the cost for a cooling step, etc , it is possible to obtain a uniform and excellent electrolytic treatment, and it is easy to control the quantity of the treatment.

Another object of the present invention is to provide a method and apparatus for performing an electrolytic treatment in which the equipment cost as well as the maintenance cost are low, and it is possible to carry out electrolytic treatment with compact equipment and with high productivity.

A further object of the present invention is to provide a method and apparatus for performing an electrolytic treatment in which even when an aluminum product having a small sectional area such as, wire, foil, thin strip, or the like is treated, there is no possibility of fusing of the aluminum product and the treatment can be performed at a high speed.

A still further object of the present invention is to provide a method and apparatus for performing electrolytic treatment in which production is stable even when the speed of electrolytic treatment is high or the quantity of electrolysis is increased, and to provide such a method and apparatus in which there is no possibility of corrosion, sparks, leakage of electricity, and the like at metal parts in a retreatment apparatus.

The above and other objects of the present invention are attained by an electrolytic treatment method and apparatus for continuously electrolyzing an elongated product of aluminum or an aluminum alloy using an electrolytic treatment apparatus constituted by at least an electrolytic section and a power supply section, wherein at least two power supply sections are provided which correspond to one electrolytic section and which are disposed respectively at the front side and rear side of the electrolytic section in the longitudinal direction of the elongated product in the electrolytic section, an electrode of the electrolytic section at the front-side half thereof is connected to an electrode of the front-side power supply section through a power source, and another electrode of the electrolytic section at the rear-side half thereof is connected to an electrode of the rear-side power supply section through another power source.

According to another embodiment of the present invention, the above objects can be attained by an electrolytic treatment method using the above-mentioned electrolytic treatment apparatus in which the potential difference between portions of the elongated product respectively at the front side and the rear side of the electrolytic treatment apparatus is detected o and the values of currents supplied to the front-side and rear-side power supply sections are controlled so as to make the potential difference substantially equal to zero. If necessary, the sum of the values of currents supplied to the front-side and rear-side power supply sections can be fixed, namely, the electrolytic treatment apparatus is provided with a control means for controlling the sum of the values of the currents supplied to the front-side and rear-side power supply sections so as to make the sum of the values of the currents be a fixed value.

As a further preferred embodiment, grounding means may be provided at the front side or rear side of the electrolytic treatment apparatus.

DESCRIPTION OF THE PREFERRED EMBODIMENTS

Figure 1:
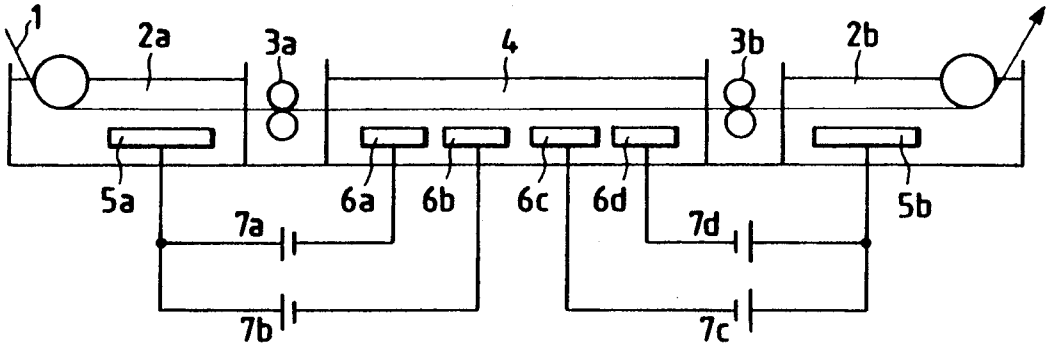
FIG. 1 is a side view showing a preferred embodiment of an electrolytic treatment apparatus of the invention in which power supply sections are disposed at the front side and rear side of an electrolytic section in the longitudinal direction of an elongated product.

FIG. 1 is a side view showing a preferred embodiment of an electrolytic treatment apparatus which attains the objects of the present invention, that is, an apparatus in which two power supply sections are provided corresponding to one electrolytic section so that a delicate electrolytic treatment such treatment for a thin product or the like can be economically performed.

In FIG. 1, an aluminum product 1, which is an object to be treated, runs from the left to the right in the drawing. The electrolytic treatment apparatus is constituted by five cells, that is, a first power supply section 2*a*, a fist intermediate section 3*a*, an electrolytic section 4, a second intermediate section 3*b*, and a second power supply section 2*b*. The intermediate sections 3*a* and 3*b* of the five cells may be omitted if unnecessary.

Although the power supply section and the electrolytic section are constituted by cells separated from each other in this embodiment, a method may be practiced in which suitable partition plates or the like are provided in one cell so as to separate the power supply and electrolytic portions from each other. Further, a plurality of units, each constituted by the sections shown in this embodiment, can be coupled longitudinally in series with each other.

Each of the power supply sections 2*a* and 2*b* and the electrolytic section 4 is filled with an electrolyte. As the electrolyte, representatively, it is possible to use sulfuric acid, phosphoric acid, oxalic acid, an aqueous solution of each of the above, a mixed solution of these acids, or the like. It suffices to select an optimum one of those mentioned above in order to obtain a desired quality. Also, the concentration and temperature of the electrolyte may be freely selected. The conditions of the electrolyte in the two power supply sections and the electrolytic section may be the same as or different from each other.

Power supply section electrodes 5*a* and 5*b* are provided in the power supply sections 2*a* and 2*b*, respectively, and electrolytic electrodes 6*a*, 6*b*, 6*c*, and 6*d* are provided in the electrolytic section 4. In this embodiment, four DC power sources 7*a*, 7*b*, 7*c*, and 7*d* are provided, the electrodes 6*a* and 6*b* provided in the front-side half portion of the electrolytic section 4 being connected to the power supply electrode 5*a* of the first power supply section 2*a* through the DC power sources 7*a* and 7*b*, respectively, and the electrodes 6*c* and 6*d* provided in the rear-side half portion of the electrolytic section 4 being connected to the power supply electrode 5*b* of the second power supply section 2*b* through the DC power sources 7*c* and 7*d* respectively. As a result, the current in the aluminum product 1 flows from the left to the right in the drawing in the front-side half portion, and the current flows from the right to the left in the drawing in the rear-side half portion.

Figure 3:
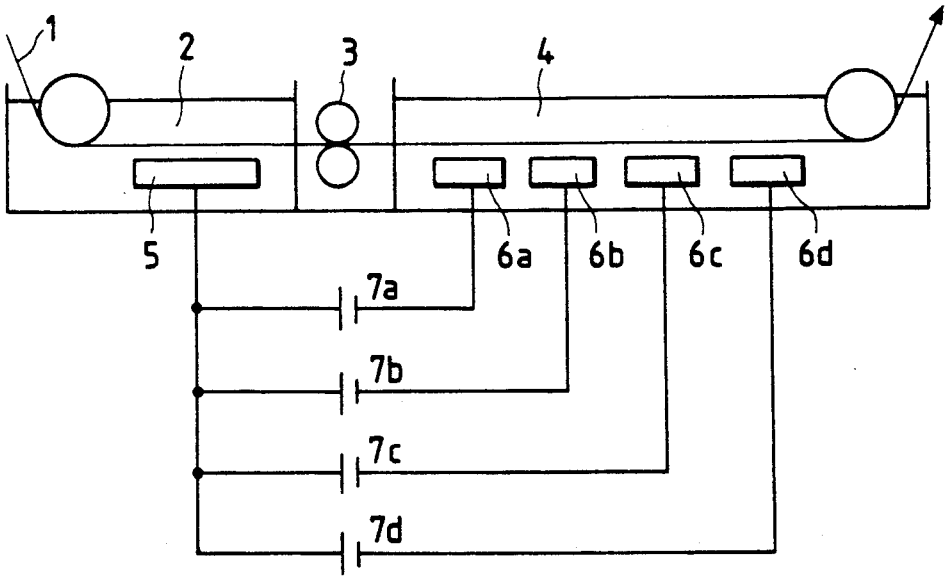
FIG. 3 PRIOR ART
FIG. 3 is a side view showing an electrolytic treatment apparatus constructed in accordance with a conventional method.
Figure 4:
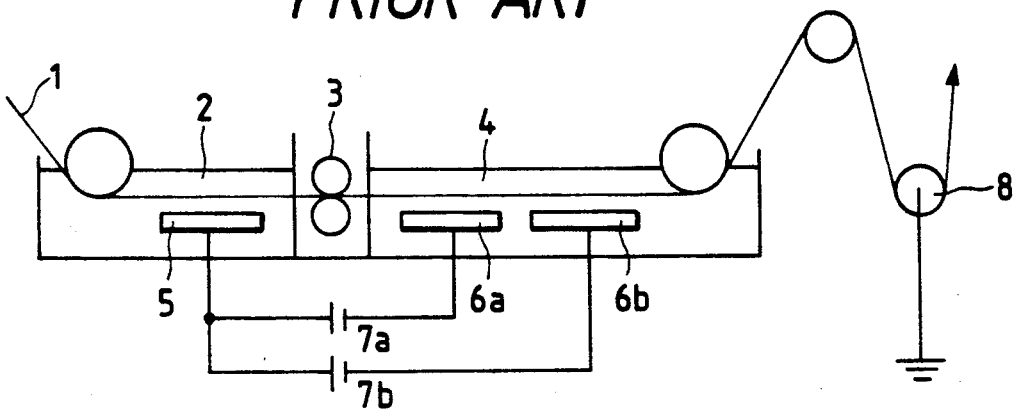
FIG. 4 PRIOR ART
FIG. 4 is a side view showing an example of a conventional electrolytic treatment apparatus provided with grounding means disposed at the rear side of an electrolytic section of an electrolytic treatment apparatus.

In each of the power sources 7*a* and 7*b*, the current flowing to the power supply electrode is halved from that required in the conventional apparatus, and therefore the voltage in the electrolysis operation decreased. In each of the power sources 7*c* and 7*d*, in addition to the foregoing reason, the distance between the power supply electrode and the electrolytic electrodes is decreased, as is apparent by comparison with FIG. 3, and therefore the electrolytic voltage is further lowered.

Although a description has been given relating to the case of using a DC waveform as the power source waveform, it is possible to select the most suitable waveform such as an AC waveform, an AC-DC superimposed waveform, or the like as the situation demands and so as to obtain a desired quality.

Further, although a description has been given relating to the case of using four power sources, the number of power sources can be selected as desired so long as the number is not smaller than two. Further, the values of all currents supplied by the power sources may be equal to each other, or, for example, the configuration may be such that the current density is gradually increased.

Also, the structure may be arranged so that the value of the supplied current can be controlled in the case where it is necessary to change the value of the feeding current of each power source, particularly, for example, in the case where it is necessary to make the quantity of electrolytic treatment on the surface of the aluminum product 1 a predetermined value or in the case where it is necessary to make the quantities of electrolysis in the front-side and rear-side half portions of the electrolytic section equal to each other to the greatest possible extent so that the composition of the electrolyte in the electrolytic cell is uniform.

In most cases, if the sum of the values of the electrolyzing currents in the electrolytic cells is the same, the quantity of the electrolytic treatment is the same. Therefore, in the preferred embodiment of the inventive electrolytic treatment method it is desirable that control be performed so that the sum of the quantities of currents supplied to the front-side and rear-side power supply sections in the electrolytic cell is fixed.

Further, as for the combinations of the power sources to be connected to the first and second power supply sections, the numbers of the power sources may be equal to each other, as shown in the illustrated case, or may be different from each other. The effects of the present invention are best achieved when the sum of the values of the currents supplied to the first power supply section is equal to that of the values of the currents supplied to the second power supply section, although the present invention is not limited to this precise situation.

Although a description has been given with reference to the case where the electrodes are disposed so as to face the same surface of an aluminum product both on the power supply side and on the electrolytic side in FIG. 1, the electrodes may be disposed so as to face the other surface of or both surfaces of the aluminum product in one of or in both of the power supply and electrolytic sides.

Figure 2:
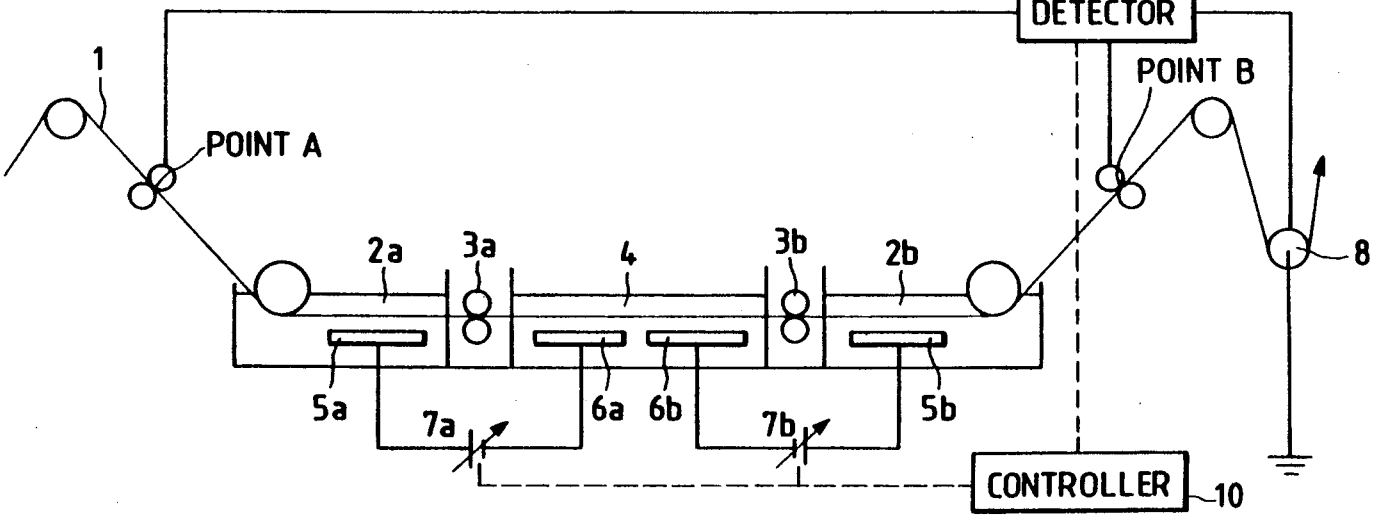
FIG. 2 is a side view showing another embodiment of an electrolytic treatment apparatus of the invention provided with a control means for controlling feeding current values and grounding means disposed at the front side or rear side of the treatment apparatus.

FIG. 2 is a side view showing another embodiment of the inventive electrolytic treatment apparatus in which even if the speed of production is made high and the quantity of electrolysis is increased, the production is stable, the electrolytic treatment current can be controlled so that electrolytic treatment of a predetermined quantity can be performed with good quality, and in which it is possible to perform the electrolytic treatment with no possibility of occurrence of corrosion, sparking, leakage of electricity, or the like at metal parts in a pretreatment apparatus.

In FIG. 2, an aluminum product 1, which is an object to be treated, runs from the left to the right in the drawing. The electrolytic treatment apparatus is constituted by five cells, that is, a first power supply section 2*a*, a first intermediate section 3*a*, an electrolytic section 4, a second intermediate section 3*b*, and a second power supply section 2*b*. The intermediate sections 3*a* and 3*b* of the five cells may be omitted if unnecessary. Further, a plurality of units each constituted by the sections mentioned above may be coupled longitudinally in series with each other.

Each of the power supply sections 2*a* and 2*b* and the electrolytic section 4 is filled with an electrolyte. As the electrolyte, representatively, it is possible to use sulfuric acid, phosphoric acid, oxalic acid, an aqueous solution of salts thereof, a mixed solution of the acids, or the like. It suffices to select an optimum one of the above in order to obtain a desired quality. Also the density and temperature of the electrolyte may be freely selected. The conditions of the electrolyte in the two power supply sections and the electrolytic section may be the same as or different from each other.

Power supply section electrodes 5*a* and 5*b* are provided in the power supply sections 2*a* and 2*b*, respectively, and electrolytic electrodes 6*a* and 6*b* are provided in the electrolytic section 4. In this embodiment, two DC power sources 7*a* and 7*b* are provided, the electrode 6*a* provided in the front-side half portion of the electrolytic section 4 being connected to the power supply electrode 5*a* of the first power supply section 2*a* through the DC power source 7*a*, and the electrode 6*b* provided in the rear-side half portion of the electrolytic section 4 being connected to the power supply electrode 5*b* of the second power supply section 2*b* through the DC power source 7*b*. As a result, the current in the aluminum product 1 flows from the left to the right in the drawing in the front-side half portion, and the current flows from the right to the left in the drawing in the rear-side half portion.

Although a description has been given as to the case of using a DC waveform as the power source waveform, it is possible to select the most suitable waveform such as an AC waveform, an AC-DC superimposed waveform, or the like as the case may require in order to obtain a desired quality.

Although a description has been given as to the case of using two power sources, four power sources can be used, as illustrated in the case of FIG. 1, and the number of power sources can be selected as desired so long as it is one or more. Further, as for the combinations of the power sources to be connected to the first and second power supply sections, the numbers of the power sources may be equal to each other, as shown in the illustrated case, or may be different from each other.

Although a description has been given as to the case where the electrodes are disposed so as to face the same surface of the aluminum product both in the power supply side and in the electrolytic side in FIG. 2, the electrodes may be disposed so as to face the other surface of or both surfaces of the aluminum product in one of or in both of the power supply and electrolytic sides.

A grounding roll 8 is provided in the line at the rear-side of the electrolytic treatment cell so as to maintain the electric potential of the aluminum product 1 at ground potential. The potential difference between a portion of the aluminum product 1 (point A) at the front side of the electrolytic treatment cell and a portion of the aluminum product (point B) at the rear side of the electrolytic treatment cell is detected by a detector 9, and the information is sent to a controller 10. In the controller 10, an operation is effected on the basis of the information received from the detector 9, and the values of currents supplied to the two DC power sources *7a* and *7b* are controlled so as to make the potential difference between the points A and B substantially equal to zero.

Further, since the quantity of anodic oxidation coating film generated on the aluminum product 1 is generally determined on the basis of the sum of the values of the currents supplied by the DC power sources *7a* and *7b*, it is desirable that control be performed by the controller 10 so as to fix the sum of the currents supplied by the two DC power sources *7a* and *7b*. Since the electrical potentials at the respective points A and B can be made equal to each other by this method, the electrical potentials at the portions of the aluminum product 1 in the front-side of and in the rear-side of the electrolytic treatment cell are maintained at ground potential so that it is possible to prevent generation of a current flowing from the electrolytic treatment cell into other treatment cells through the aluminum product.

Still further, control may be performed in a such a manner as to fix the sum of the values of currents supplied by the power supply sections at the front side and rear side of the electrolytic section, and a grounding device may be provided at least one of the front side and the rear side of the electrolytic treatment apparatus in the longitudinal direction of an elongated product which passes through the electrolytic treatment apparatus.

Examples of the invention will now be described:

An example in which the electrolytic treatment method according to the present invention can be specifically realized will be described hereunder with reference to FIG. 1. This specific example, however, will be described merely for the purpose of aiding the understanding of the present invention, and therefore the present invention is not limited to the specific example.

EXAMPLE

Using an electrolytic apparatus having the configuration of FIG. 1 in which the length of the cell of the electrolytic section was 12 m and the length of the cell of each of the first and second power supply sections was 5 m, an elongated -strip aluminum product having a thickness of 0.2 mm and a width of 1000 mm was transported through an electrolytic treatment line at a speed of 100 m/min and there subjected to an anodizing treatment at a current density of 50 A/dm$^2$ so that an anodic oxidation coating film having a film thickness of 2 μm was formed thereon. A sulfuric acid aqueous solution was used as the electrolyte in each of the electrolytic and power supply sections, and the liquid concentration and the liquid temperature were 15 vol % and 25° C., respectively. As a result, the electrolyzing voltages of the power sources *7a, 7b, 7c,* and *7d* were 48 V, 52 V, 52 V, and 48 V, respectively, and the total electric power consumed was 2500 kW. Further, the total calorific quantity in the cells was 2,200,000 kcal/hr, and the surface temperature of the aluminum product in each of the first and second intermediate cells was 50° C. The treatment was stably performed even over long periods of time.

COMPARISON EXAMPLE

Using an electrolytic apparatus having the configuration of FIG. 1 in which the length of the cell of the electrolytic section was 12 m and the length of the cell of each of the first and second power supply sections was 5 m, an anodizing treatment was performed so that an anodic oxidation coating film having a film thickness of 2 μm was formed. Other conditions were the same as those of Example 1.

As a result, the electrolyzing voltages cf the power sources *7a, 7b, 7c,* and *7d* were 70 V, 83 V, 92 V, and 98 V, respectively, and the total electric power consumed was 4500 kw. Further, the total calorific quantity in the cells was 3,800,000 kcal/hr, and the surface temperature of the aluminum product in the intermediate sections was 90° C. The aluminum product was fused out after two minutes elapsed from initiation of treatment, and hence the treatment could not be continued beyond that point.

As apparent from the above Example, in the method according to the present invention, it is possible to perform a desired electrolytic treatment at a low electrolyzing voltage in comparison with the conventional method. Therefore, the amount of electric power supplied may be reduced, and also the calorific value in the process reduced to thereby, reduce the cooling load to thereby considerably reduce the costs required for the process. Further, since it is not necessary to use power source equipment having a large capacity for boosting the power source voltage, it is possible to realize compact power source equipment the cost of which is low.

Further, even in the case of an aluminum product such as a wire product, a foil product, a thin strip product or the like having a small sectional area, it is possible to realize stable electrolytic treatment having no possibility of occurrence of fusion of the aluminum product.

Moreover, in the method according to the present invention, a current flowing from the electrolytic treatment cell into other stages through the aluminum product can be prevented from being generated, and therefore stable electrolyte treatment having no possibility of corrosion, sparking, or leakage of electricity at metal parts in a pretreatment apparatus is realized. As the foregoing problems are eliminated, the equipment cost as well as the maintenance cost of the electrolytic treatment apparatus are low. Furthermore, it is possible to realize stable electrolytic treatment even when the speed of production is high and the quantity of electrolysis is increased.

What is claimed is:

1. An electrolytic treatment apparatus for continuously electrolyzing an elongated product of aluminum or an aluminum alloy, comprising: at least one electrolytic section, and a front-side power supply section and a rear-side power supply section disposed respectively at front and rear sides of said electrolytic section in the longitudinal direction of the elongated product in said electrolytic section, each of said power supply sections comprising at least one electrode and said electrolytic section comprising a plurality of electrodes, each of the electrolytic section and said power supply sections adapted to contain separate sections of electrolyte in which said elongated product and said electrodes may be immersed, a plurality of power sources, an electrode in said electrolytic section at a front-side portion thereof being connected to an electrode of said front-side power supply section through one of said power sources, and another electrode in said electrolytic section at a rear-side portion thereof being connected to an electrode of said rear-side power supply section through another of said power sources, said electrodes in the front and back side portions of the electrolytic section being adapted for immersion in a single common section of the electrolyte.

2. The electrolytic treatment apparatus of claim 1, further comprising means for detecting a potential difference between sections of said elongated product respectively at the front side and at the rear side of said electrolytic treatment apparatus, and means for controlling values of currents supplied by said front-side and rear-side power supply sections so as to make said potential difference substantially equal to zero and to maintain the sum of said values of said currents supplied to said front-side and rear-side power supply section at a predetermined fixed value.

3. The electrolytic treatment apparatus of claim 2, further comprising grounding means disposed at a rear side of said rear-side power supply section.

4. The electrolytic treatment apparatus of claim 2, further comprising grounding means disposed at a front side of said front-side power supply section.

5. The electrolytic treatment apparatus of claim 1, wherein said electrolytic section comprises at least four electrodes, and at least four said power sources are provided, two of said electrodes of said electrolytic section at a front-side portion thereof being connected to an electrode of said front-side power supply section through a respective pair of said power sources, and two of said electrodes of said electrolytic section at a rear-side portion thereof being connected to an electrode of said rear-side power supply section through another respective pair of said power sources.

6. The electrolyte treatment apparatus of claim 1, wherein a first current path flows through the elongated product between the front-side electrolytic section electrode and the front-side power supply electrode, and a second current path flows through the elongated product between the back-side electrolytic section electrode and the back-side power supply electrode, such that said first and second current paths flow in opposite directions through the elongated product.

7. The electrolytic treatment apparatus of claim 1, wherein said plurality of electrodes in the electrolytic section have a first polarity, and the electrodes in the front- and back-side power supplies have a second polarity, such that current flowing through the elongated product flows into the electrolytic section through both, the front and back-side portions thereof.

8. The electrolytic treatment apparatus of claim 1, wherein said electrodes in the electrolytic and power supply sections produce a first and a second electric currents in the elongated product that flow in opposite directions through the elongated product.

9. An electrolytic treatment method for continuously electrolyzing an elongated product of aluminum or an aluminum alloy, comprising the steps of: passing said elongated aluminum product successively through a front-side power supply section, ann electrolytic section, ad a rear-side power supply electrode and said electrolytic section containing a plurality of electrodes, each of the electrolytic section and said power supply sections containing separate sections of an electrolyte in which said elongated product and said electrodes are immersed; applying a first electric current from a first power source between an electrode in said and electrolytic section at a front-side portion thereof and an electrode in said front-side power supply section; and applying a second electric current from a second power source between an electrode of said electrolytic section at a rear-side portion thereof and an electrode of said rear-side power supply section, said first and second electric currents flowing in opposite directions through said elongated product.

10. The electrolytic treatment method of claim 9, further comprising the steps of: detecting a potential difference between sections of said elongated product respectively at the front side and at the rear side of said electrolytic treatment apparatus, and controlling values of said first and second electric currents so as to make said potential difference substantially equal to zero and to maintain the sum of said values of said first and second currents at a predetermined fixed value.

11. The electrolytic treatment method of claim 10, further comprising the step of grounding said elongated product at a rear side of said rear-side power supply section.

12. The electrolytic treatment method of claim 10, further comprising the step of grounding said elongated product at a front side of said front-side power supply section.

13. The electrolytic treatment method of claim 9, wherein said electrolytic section comprises at least four electrodes, and at least four power sources are provided, two of said electrodes of said electrolytic section at a front-side portion thereof being connected to an electrode of said front-side power supply section through a respective pair of said power sources, and two of said electrodes of said electrolytic section at a rear-side portion thereof being connected to an electrode of said rear-side power supply section through another of respective pair of said power sources.

14. The electrolytic treatment method of claim 9, wherein said first electric current flows through the elongated product from the front-side electrolytic section electrode to the front-side power supply electrode, and said second electric current flows through the elongated product from the back-side electrolytic section electrode to the back-side power supply electrode.

15. The electrolytic treatment method of claim 9, further comprising:

applying a first polarity to said plurality of electrodes in the electrolytic section, and a second polarity to the electrodes in the front- and back-side power supplies, to provide said first and second opposite electric currents.

16. The electrolytic treatment method of claim 9, wherein said plurality of electrodes in the electrolytic section are immersed in a single common section of electrolyte.

17. An electrolytic treatment apparatus for continuously electrolyzing an elongated product of aluminum or an aluminum alloy, comprising:

at least one electrolytic section, front-side and rear-side power supply sections disposed respectively at front and rear sides of said electrolytic set in the longitudinal direction of the elongated product in said electrolytic section, each of said power supply sections comprising at least one electrode and said electrolytic section comprising a plurality of electrodes, a plurality of power sources, wherein a first electrode in said electrolytic section at a front-side portion thereof is connected to an electrode of said front-side power supply section through one of said power sources and generates a first electrical current through the elongated product, and a second electrode in said electrolytic section at a rear-side portion thereof is connected to an electrode of said rear-side power supply section through another of said power sources an generates a second electrical current through the elongated product, said first and second electrical currents flowing in opposite directions through said elongated product.

* * * * *